United States Patent [19]

Kull et al.

[11] Patent Number: 4,656,986

[45] Date of Patent: Apr. 14, 1987

[54] DEVICE FOR MODIFYING OPERATION OF REGULATOR FOR SETTING FUEL QUANTITY IN AN INTERNAL COMBUSTION ENGINE OPERATING WITH SELF-IGNITION

[75] Inventors: Hermann Kull, Stuttgart; Wilfried Sautter, Ditzingen; Wolf Wessel, Oberriexingen, all of Fed. Rep. of Germany

[73] Assignee: Robert Bosch GmbH, Stuttgart, Fed. Rep. of Germany

[21] Appl. No.: 670,144

[22] Filed: Nov. 9, 1984

[30] Foreign Application Priority Data

Dec. 3, 1983 [DE] Fed. Rep. of Germany ..... 3343854

[51] Int. Cl.[4] ..... F02M 39/00

[52] U.S. Cl. ..... 123/357; 123/419; 123/352

[58] Field of Search ..... 123/357, 358, 359, 352, 123/419

[56] References Cited

U.S. PATENT DOCUMENTS

| | | | |
|---|---|---|---|
| 4,329,960 | 5/1982 | Woodhouse | 123/419 |
| 4,343,278 | 8/1982 | Asa | 123/419 |
| 4,377,998 | 3/1983 | Hartel | 123/419 |
| 4,428,341 | 1/1984 | Hassler | 123/359 |
| 4,471,735 | 9/1984 | Collonia | 123/352 |
| 4,538,571 | 9/1985 | Bulk | 123/357 |

*Primary Examiner*—Carl Stuart Miller

*Attorney, Agent, or Firm*—Michael J. Striker

[57] ABSTRACT

Disclosed is a jolt damping circuit for use in fuel metering systems of an internal combustion engine having self-ignition. The jolt damping circuit includes a guide regulator, a device for generating a jolt disturbance signal in dependency on the rotary speed of the engine, and means for combining the output signal from the guide generator and from the jolt disturbance signal generator to produce a desired value setting signal applicable to regulating means for the setting member of a fuel injection pump. The jolt damping circuit is directly connectable into a standard fuel metering system of a motor vehicle.

15 Claims, 7 Drawing Figures

DEVICE FOR MODIFYING OPERATION OF REGULATOR FOR SETTING FUEL QUANTITY IN AN INTERNAL COMBUSTION ENGINE OPERATING WITH SELF-IGNITION

BACKGROUND OF THE INVENTION

The present invention relates in general to internal combustion engines operating with self-ignition and in particular to a device for modifying operational condition of a fuel metering system in the engine, the system including means for sensing at least one operational variable of the engine, an end stage regulator for setting fuel quantity, and control means connected to the sensing means for producing a first nominal setting signal.

A motor vehicle due to the elastic suspension of the engine on the vehicle body represents an oscillatory structure which in the occurrence of a disturbance can be induced into more or less damped oscillations. Such disturbances result for example from a jump in the fuel quantity introduced by the fuel metering system of the engine or can result from external influences for example due to sudden jump of the vehicle caused by a pothole in the road. The resulting oscillations which are manifested by changes of rotary speed of the engine or by relative movements between the engine and the body of the vehicle are normally in the frequency range between 1 and 8 Hertz and are termed as jolting or jerking of the vehicle.

In the U.S. patent application Ser. No. 513,984 a device for damping jolting oscillations in an internal combustion engine with self-ignition is described. In this prior art device a regulating circuit is installed between a control unit for a nominal value and the control mechanism for fuel quantity metering of an injection pump. The regulating circuit by means of signals derived from the rotary speed of the engine and of the position of the fuel quantity setting mechanism influences the fuel metering for the engine in such a manner that the jolting vibrations are strongly damped.

The disadvantage of this prior art device is the fact that the regulating system requires relatively high expenditures for circuit elements. In addition, it requires for its operation a mutual adjustment of a relatively large number of operational variables of the engine. As a consequence, this known device cannot be additionally installed in standard fuel metering systems of the engine.

SUMMARY OF THE INVENTION

It is therefore a general object of the present invention to overcome the aforementioned disadvantages.

More particularly, it is an object of the invention to provide an improved modifying device of the aforedescribed kind which has a simpler architecture with a reduced number of functional units as well as a reduced number of input variables for achieving the same damping effect on jolting oscillations as prior art devices.

A primary object of this invention is to obtain a modifying device which can be additionally installed into and matched with conventional fuel metering systems of internal combustion engines.

In keeping with these objects and others which will become apparent hereafter, one feature of this invention resides in the provision of a device for modifying operational conditions of a fuel metering system which comprises a guide regulator connected to the control means for generating from the first nominal setting signal a guide value signal, modifying means connected to the sensing means for producing a modifying signal, and means for combining the guide value signal with the modifying signal to produce a second nominal setting signal applicable to the end stage regulator.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

The below-described embodiments relate to regulating devices for influencing fuel metering system of an internal combustion engine operating with self-ignition.

Figure 1:
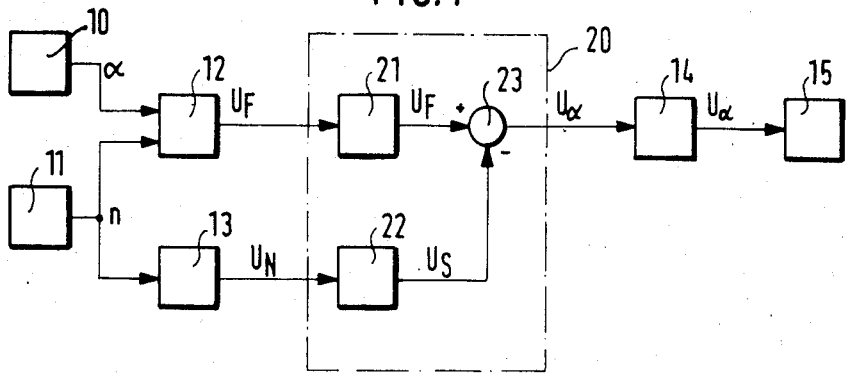
FIG. 1 is a block circuit diagram of a fuel metering system of an internal combustion engine including a jolt damping device of this invention.

FIG. 1 illustrates in schematic block diagram of a conventional fuel metering system of an internal combustion engine 15 which is provided with a jolt damper 20 according to this invention. The fuel metering system includes a position sensor 10 of acceleration pedal and a rotary speed sensor 11 of the engine. A control unit 12 of a desired or nominal value setting signal has its inputs connected to the position sensor 10 and to the rotary speed sensor 11. A converter 13 has its input connected to the rotary speed sensor 11 only. The jolt damper 20 includes a guide value regulator 21, a device 22 for generating jolt disturbance signal, and an adder 23 for combining the guide value signal with the jolt disturbance signal into a second nominal setting signal. The guide value regulator 21 is connected to the output of the nominal value control unit 12 and the jolt disturbance signal generator 22 is connected to the output of converter 13. The inputs of the adder 23 are connected to the outputs of circuits 21 and 22. The output of adder 23 is connected to the input of an end stage regulator 14 for setting fuel quantity of the internal combustion engine 15.

In the circuit of FIG. 1, the sensors 10 and 11, the desired value control unit 12 and the end stage setting regulator 14 represent a standard fuel metering system of the internal combustion engine. The desired value control unit 12 has the task to produce from the angular position value $\alpha$ of the acceleration pedal and from the rotary speed n of the engine a first nominal setting signal $U_{FSOLL}$ which in the subsequent guide regulator 21 is modified into a guide signal value $U_F$. The purpose of the end stage regulator 14 is to execute as fast as possible an exact adjustment of its output signal $U_{\alpha ist}$ to the nominal output signal $U_{FSOLL}$ from the jolt damper 20 as it will be described below.

In the jolt damper 20 the guide value signal generator produces at its output a signal $U_F$ and the jolt disturbance signal generator 22 produces from the rotary speed dependent signal $U_N$ at the output of converter 13, a modifying output signal $U_S$. The two signals $U_S$ and $U_F$ are applied to mixing circuit 23 where a difference signal $U_{\alpha SOLL}$ is produced.

In designing the guide setting regulator 21 and the jolt disturbance signal generator 22 there are various possibilities. In the basic construction of this invention, the jolt damper 20 can be readily incorporated into and matched with the existing fuel metering system of a motor vehicle.

The control unit 12 for the desired or nominal value of the fuel flow setting, as well as the converter 13 are devices well known from prior art. For example, the unit 12 operates with a field of characteristics to generate its output signal $U_{FSOLL}$ in dependency on the input variables $\alpha$ and n, whereas the converter 13 is a conventional frequency-voltage converter.

Figure 2:
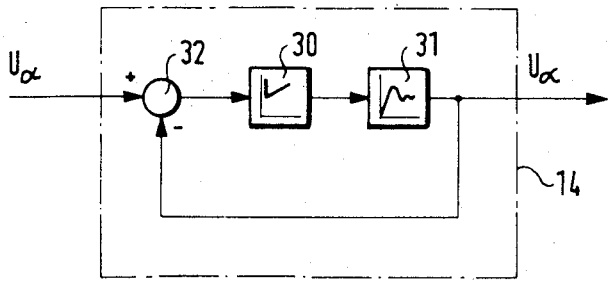
FIG. 2 is an exemplary embodiment of an end stage regulating circuit for setting fuel quantity.

FIG. 2 illustrates an exemplary embodiment of the known end stage regulator 14 for setting fuel quantity. Reference numeral 30 denotes a regulator, for example a PID regulator while block 31 represents a fuel quantity setting mechanism of an injection pump. Block 32 represents a logic element for combining the signals $U_{\alpha SOLL}$ and $U_{\alpha ist}$. The output signal from the logic element 32 (subtractor) is applied to the regulator 30 whose output signal controls the setting mechanism 31 of the fuel injection pump. In particular, the regulator 30 controls the fuel injection mechanism 31 in such a manner that the difference between the two signals $U_{\alpha ist}$ and $U_{\alpha SOLL}$ is always kept close to zero, that means that the actual position of the fuel quantity setting mechanism 31 be always as close as possible to the desired or nominal position.

Figure 3:
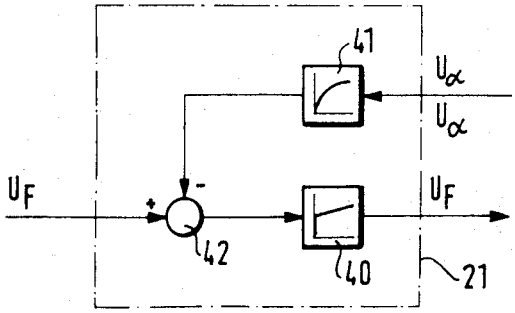
FIG. 3 is an exemplary embodiment of a guide regulator.

FIG. 3 shows an exemplary embodiment of a guide regulator 21. Block 40 represents a regulator, such as PI-regulator, block 41 is a low pass filter and block 42 is a combining logic element (subtractor). The logic element 42 combines signals $U_{FSOLL}$ from the control unit 12 and the output signal from the low pass filter 41. The output signal from the logic element 42 is supplied to the regulator 40 which produces at its output the signal $U_F$. The input signal of the low pass filter 41 can be either the desired or nominal value of the setting signal applied to the input of the end stage regulator or the actual value of the setting signal produces at the output of the end stage regulator. If the nominal setting signal $U_{SOLL}$ is applied to the low pass filter 41, then the jolt damper 20 of this invention is completely applicable for installation in the existing fuel metering system of the motor vehicle inasmuch as in this case the signal $U_{\alpha SOLL}$ is produced by the jolt damper 20 itself. On the other hand, if the actual setting signal $U_{\alpha ist}$ is applied to the low pass filter 41, then this signal $U_{\alpha ist}$ is generated outside the jolt damper 20. In the latter case the applicability of the jolt damper 20 in the standard fuel metering system of the engine is made possible only if it is feasible to apply the actual position setting signal $U_{\alpha ist}$ for the position setting mechanism of fuel metering system to the jolt damper.

If the nominal setting signal $U_{\alpha SOLL}$ is fed back then care must be taken that the following end stage setting regulator 14 has no remaining deviation between the signals $U_{\alpha SOLL}$ and $U_{\alpha ist}$, and that the dynamic of this setting regulator 14 determines the overall jolt damping action. It is also possible, depending on the design of the fuel quantity setting mechanism of the fuel injection pump 31 as well as on the overall construction of the jolt damper, to dispense with the low pass filter 41 and apply directly the feed back signal $U_{\alpha SOLL}$ or $U_{\alpha ist}$ to the combination logic element 42. The purpose of regulator 40 is to modify or readjust the signal $U_F$ to the nominal input signal $U_{FSOLL}$. In designing the regulator 40 care must be taken that the latter possess a proper guiding behavior that means that the signal $U_F$ quickly and accurately readjusts the jump of the input nominal signal $U_{FSOLL}$ and that inspite of this guiding behavior the effect of the jolt damper 20 is not cancelled. In a variation it is also possible that the regulator 40 has no TI behavior but it may possess also another regulating characteristic matching the particularity of the corresponding jolt damper. The basic concept of the jolt damper 20 and the corresponding construction of the guide regulator 21 as shown in FIG. 3 makes signal shaping of the guide signal, that is for example a rise limitation or an unsensitivity zone of the signal in the subsequent setting regulator, is unnecessary.

Figure 4:
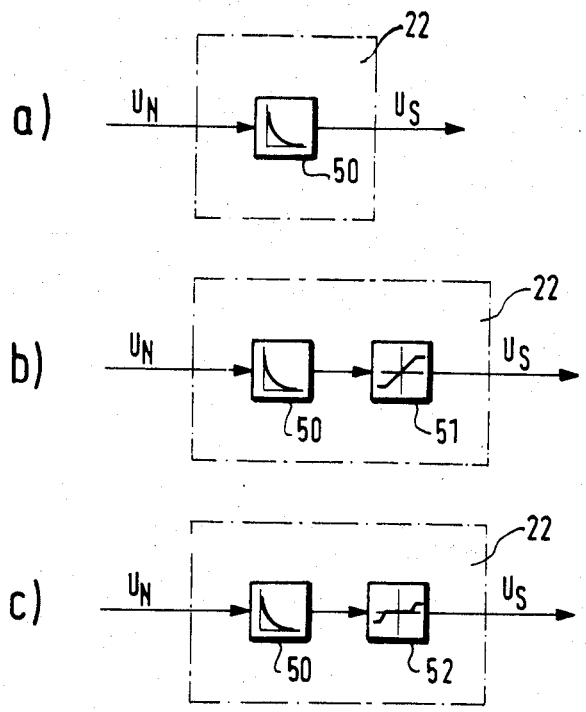
FIGS. 4A through 4C show respectively different embodiments of a device for generating a modifying signal corresponding to a jolting disturbance.

FIG. 4 shows three embodiments of a device for generating jolt disturbance signals. In these embodiments, block 50 is a high pass filter, block 51 represents a device for limiting slope or rise of the signal, and block 52 is a device for limiting slope of the signal with an unsensitivity zone. In the simplest case as illustrated in FIG. 4A, the jolt disturbance generator 22 includes only a high pass filter 50. The purpose of this high pass is to detect the jolting vibrations and produce an output disturbance signal $U_S$ which is proportional to the magnitude of these jolting vibrations. Before applying the jolting disturbance signals to the adder or subtractor 23, it may be necessary to limit the slope of these signals in the rise limitor 51, as illustrated in FIG. 4B. Still another shaping of the jolt disturbance signal $U_S$ is indicated in FIG. 4C where the output signal from the high pass filter 60 is applied to a slope limiting device 52 having an unsensitive zone. To decide which of the three possibilities illustrated in FIG. 4 is to be employed for the construction of the jolt disturbance signal $U_S$ depends on the actual fuel metering system of the motor vehicle, primarily on the employed fuel quantity setting mechanism of the injection pump. It is also feasible to employ other constructions of devices for shaping the signal $U_S$, differing from those shown in FIG. 4.

Figure 5:
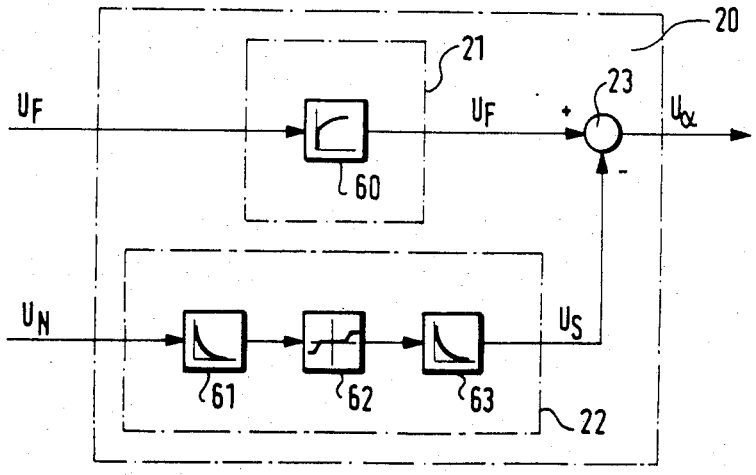
FIG. 5 is another embodiment of a damping device of this invention.

Another exemplary embodiment of a jolt damper is shown in FIG. 5. The guide regulator 21 for setting fuel quantity in this example of jolt damper consists of a guide shaper 60. The device 22 for generating the jolt disturbance signal consists of a first high pass filter 61 of a signal shaping device 62 and of a second high pass filter 63. The input signal $U_{FSOLL}$ is fed to the guide shaper 60 whose output signal $U_F$ is then combined with the jolt disturbance signal $U_S$ in the logic element 23. The series connection of the first high pass filter 61 of the signal shaper 62 and of the second high pass filter 63 is supplied with the rotary speed dependent signal $U_N$ from the output of converter 13. The modified difference signal from the logic element 23 is the nominal first setting signal $U_{\alpha SOLL}$ which is applied to the input of the following end stage regulator 14. Since in the jolt damper of FIG. 5 the rotary speed dependent signal $U_N$ after passing through the double high pass filter is applied as the jolt disturbance signal and after combination with the guide setting signal from the regulator 21 is applied directly to the end stage setting regulator 14, whereby the guide regulator 21 is constituted by the guide shaper 16 only, no feed back of $U_{\alpha SOLL}$ or $U_{\alpha ist}$ takes place. The construction of the guide shaper 60 can be made in different ways, for example in the form of a $TDP_1$-member. Also the signal shaping device 62 may have different construction such as a slope limiter defining an unsensitivity zone. The jolt damper 20 of FIG. 5 is constructed such as to be readily connectable between the control unit 12 and the end stage regulating circuit 14 of the existing fuel metering system of the engine. By selecting a suitable variation of the construction of the jolt damper 20 of FIG. 5, it is possible to adjust the same to different types of standard fuel metering systems.

A particular advantage of the jolt damper 20 is its truly simple construction. This feature has the consequence that in matching the jolt damper of this invention to existing fuel metering systems of an engine, only a very limited number of setting parameters is to be affected. The small number of setting parameters makes it possible to control the latter in dependency on other engine variables, such as for example, on temperature, rotary speed of the engine, of the shifted gear and the like.

During the starting of the engine, it has been found advantageous to limit the effect of the jolt damper. This limitation can be achieved for example by making the speed dependent signal $U_N$ a constant voltage signal when the rotary speed drops below a predetermined limit value, thus making the signal $U_N$ independent on the actual rotary speed of the engine. The conversion to the constant voltage in the course of the starting process of the engine can be produced by the converter 13.

In addition, it has been found as advantageous to insure that the jolting vibrations do not affect the nominal value signal $U_{FSOLL}$. The influence of the jolting on the value of the latter signal can be prevented in such a manner that in the control unit 12 for the desired setting value signal the signal n delivered by the rotary speed sensor 11 is first passed through a low pass filter in which first jolting oscillations are filtered out. The latter filtering, of course, is not permitted to affect the signal $U_N$ at the output of the converter 13 inasmuch as in the subsequent device 22 the output signal $U_S$ is produced just on dependency on the fast jolting vibrations.

In another modification, the individual building blocks the before described embodiments as a whole can be integrated into a single functional unit. This integrated circuit may include, for example, the control unit for controlling the desired setting value, the jolt damper, the end stage regulating circuit and the like. In this manner a unit is created which by using analog circuit technology is concentrated in the smallest possible space.

In a particularly advantageous embodiment of the device for modifying the regulating circuit for setting fuel quantity in an internal combustion engine operating with selfignition, by using digital design, the entire device can be controlled by a microprocessor equipped with corresponding programming.

In still another modification the jolt damper of this invention need not be connected to the setting mechanism of the injection pump, but instead may affect other variables which influence the combustion in the engine.

It will be understood that each of the elements described above, or two or more together, may also find a useful application in other types of constructions differing from the types described above.

While the invention has been illustrated and described as embodied in a jolt damper in connection with a regulator for a setting mechanism for an injection pump of the internal combustion engine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A device for regulating a fuel metering system of a diesel engine comprising:

sensing means including a gas pedal position sensor and a rotary speed sensor;

an end stage regulator for controlling a fuel quantity setting member;

means for producing in response to signals from said sensing means a nominal signal corresponding to a desired fuel quantity;

jolt damping means connected between said producing means and said end stage regulator, said jolt damping means including a guide regulator for adjusting said nominal signal and means for generating a modifying signal corresponding to low frequency fluctuations of rotary speed of the engine; means for combining said nominal signal and said modifying signal to produce a modified nominal signal, said combining means being directly coupled to said end stage regulator to counteract said fluctuations by a corresponding change in the adjusted fuel quantity; and means for limiting the rise of said modifying signal to a preset value.

2. A device as defined in claim 1, wherein the guide regulator includes a regulator and a combining device connected to the regulator, the combining device having an input connected to the output of the producing means and another input coupled to the end stage regulator to receive a feed back signal from the latter.

3. A device as defined in claim 2, wherein the guide regulator includes a regulator having a PI behavior.

4. A device as defined in claim 2, wherein a phase shifter is connected to the other input of the combining device to shift the phase of the feed back signal.

5. A device as defined in claim 4, wherein the phase shifter is in the form of a low pass filter.

6. A device as defined in claim 1, wherein said generating means includes a phase shifter for generating said modifying signal from the output signal of the rotary speed sensor.

7. A device as defined in claim 6, further comprising a signal shaping device connected to the phase shifter to produce a disturbance signal which is dependent on fast changes of rotary speed.

8. A device as defined in claim 6, wherein the phase shifter is in the form of a high pass filter.

9. A device as defined in claim 7, wherein the signal shaper includes a signal slope limitor having a signal insensitive zone.

10. A device as defined in claim 1, wherein the guide regulator includes a guide signal shaper, and said generating means including two phase shifters and a signal shaper connected between said phase shifters.

11. A device as defined in claim 10, wherein the guide shaper has $PDT_1$ behavior.

12. A device as defined in claim 10, wherein each of the two phase shifters is a high pass filter.

13. A device as defined in claim 10, wherein the signal shaper connected between the two phase shifters is a signal slope limiter having an insensitive zone.

14. A device as defined in claim 1, wherein said sensing means includes a temperature sensor, and a shifted gear sensor to produce signals applicable to the modifying device.

15. A device as defined in claim 1, comprising a signal converter connected between the sensing means and the modifying means to convert when the rotary speed drops below a predetermined value, the output signal from the rotary speed sensor into a constant signal.

* * * * *